US005096305A

United States Patent [19]

Rimondi et al.

[11] Patent Number: 5,096,305

[45] Date of Patent: Mar. 17, 1992

[54] HANDLE BAG OF PLASTIC FILM

[75] Inventors: Renato Rimondi, Bazzano; Angelo Cappi, Vignola, both of Italy

[73] Assignee: A.W.A.X. Progettazione e Ricerca S.r.l., Italy

[21] Appl. No.: 618,886

[22] Filed: Nov. 28, 1990

[30] Foreign Application Priority Data

Dec. 22, 1989 [IT] Italy ..... 12619 A/89

[51] Int. Cl.[5] ..... B65D 33/06

[52] U.S. Cl. ..... 383/37; 383/8; 383/9; 206/390

[58] Field of Search ..... 206/390; 383/8, 9, 37, 383/119; 493/226, 926

[56] References Cited

U.S. PATENT DOCUMENTS

| | | | |
|---|---|---|---|
| 2,653,751 | 9/1953 | Vogt | 383/37 |
| 3,027,065 | 3/1962 | Lindquist et al. | 383/37 |
| 4,464,157 | 8/1984 | Benoit et al. | 493/226 |
| 4,529,090 | 7/1985 | Pilon | 383/8 |
| 4,720,872 | 1/1988 | Kaczerwaski | 383/8 |
| 4,807,754 | 2/1989 | Rowe | 206/390 |
| 4,846,349 | 7/1989 | Galimberti | 206/390 |
| 4,849,090 | 7/1989 | Case et al. | 383/37 |
| 4,859,082 | 8/1989 | Llorens et al. | 383/8 |
| 4,911,560 | 3/1990 | Hoover et al. | 383/8 |

FOREIGN PATENT DOCUMENTS

| | | |
|---|---|---|
| 1229825 | 12/1987 | Canada . |
| 159939 | 4/1985 | European Pat. Off. . |
| 1390368 | 1/1965 | France . |
| 7927786 | 11/1979 | France . |

*Primary Examiner*—Gary E. Elkins

*Attorney, Agent, or Firm*—Larson and Taylor

[57] ABSTRACT

A T-shirt or handle bag of plastic film material of the foldable type and provided with handles, which is connected in single file with further identical bags from which it may be separated by tearing-off along weakened areas. A roll formed from a continuous ribbon of bags is adapted to be supplied for use in apparatuses for automatically dispensing and opening the bags into which the goods that have been bought at the checkout counters of a store. In order to obtain a constant-size roll [(B)] by rolling up a continuous ribbon on a central core [(A)], the handle bag is dimensioned so that each one of its folded lateral portions [(S1–S2)] has a width which is not smaller than one third of the total width [(L)] of the bag in its flattened condition.

9 Claims, 6 Drawing Sheets

HANDLE BAG OF PLASTIC FILM

BACKGROUND AND SUMMARY OF THE INVENTION

The present invention relates to handle bags (known also as T-shirt bags) made of thin high strength plastic film. A handle bag of the type referred to comprises an upper end defining the bag mouth, a lower end defining the bag bottom, two opposite vertical folded side portions each presenting four superposed layers of film, an intermediate portion, between the said folded portions, presenting two layers of superposed film, and two handles formed in the folded side portions at their upper ends. The handle bags are supplied (for example) at store checkout counters, from suitable dispensing apparatuses which may also comprise opening means for opening the bag and holding it in a vertical position for receiving the goods which are dropped inside same. Usually, a supply of handle bags is stored, inside the dispensing and opening apparatuses, in the form of a continuous ribbon of pre-formed bags, connected in end-to-end relationship at regions which have been weakened, for example by means of perforations, so that they can be separated from each other by a simple tear-off action.

SUMMARY OF THE INVENTION

The object of the invention is to provide a handle bag of the above mentioned type suitable to be supplied from dispensing apparatuses and adapted to solve the following problems:

1) the continuous ribbon formed of handle bags must be rolled up about a central core, possibly without any side holding flanges, so as to form a roll which is structurally firm and without any creases;
2) when a roll of pre-formed bags is near to depletion, the trailing end of the roll must be connected to the leading end of a new roll so as to ensure the continuous supply to the dispensing apparatus;
3) the bags must be adapted to be handled with no trouble by the apparatus which dispenses them, which suitably positions them for filling, and which opens them.

According to the invention, a bag of the above mentioned type is characterized by the fact that each one of its vertical folded side portions has a width which is not smaller than one third of the total width of the bag in its flattened condition.

Still according to the invention, the handles of the bag present a height which is equal to, or slightly different from, half the length of the portion of the mouth of the bag which is included between the two inner points at which each handle is connected to the mouth.

BRIEF DESCRIPTION OF THE DRAWINGS

The features of the handle bag according to the invention and the advantages resulting therefrom will appear from the following description of some preferred embodiments, shown merely by way of example in the attached drawings, in which.

DESCRIPTION OF THE PREFERRED EMBODIMENTS

Figure 1:
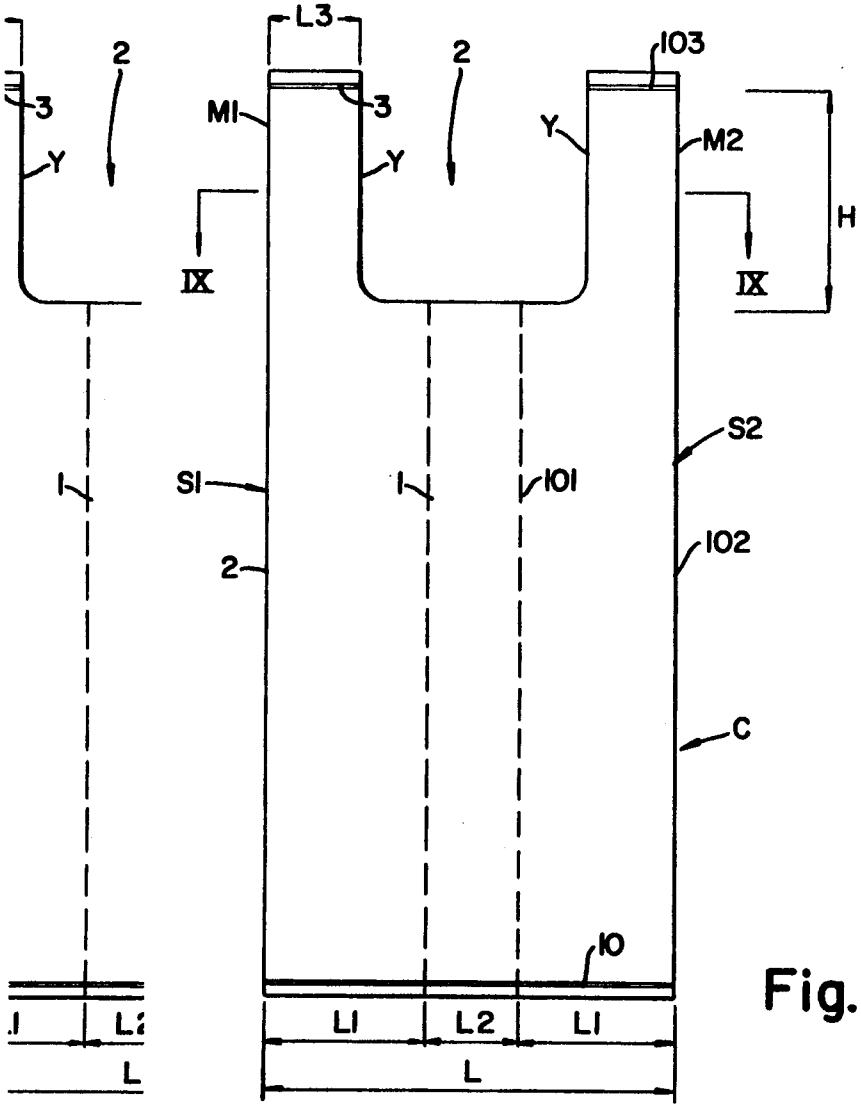
FIG. 1 is a plan view of a handle bag according to the invention, in its closed flattened condition.
Figure 9:
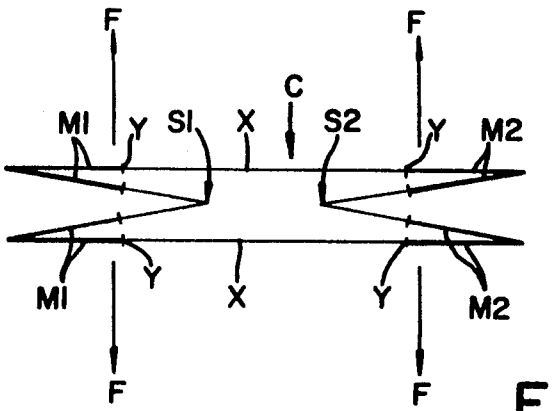

FIGS. 1 and 9, to which reference is made first, show a handle bag C (also called "T-shirt bag") made of thin high strength plastic film. The bag is obtained (as it is known in the prior art) either from a continuous tube or from a plurality of continuous sheets of suitable heat-sealable plastic film which by means of one or more longitudinal seals are connected to each other so as to form a continuous tube. The tube is provided with opposite and equal longitudinal folds S1-S2 and is then provided at constant intervals P (for example of the length of about 500–650 mm) with transverse seals 10 which close the bottom of each bag. At a short distance from each seal 10 and at a central position, each bag-forming portion is provided with a cutout opening 2 which gives origin to the handles M1-M2 of the bag itself, closed at the top by seals 3-103 which are aligned with each other and parallel to the seal 10. The areas connecting the handles M1-M2 of each bag to the bottom of the successive bag are provided with weakening slits or perforations 4-104 (to be discussed below), whereby upon subjecting the bag to a longitudinal traction effort, said bag is torn off from the continuous ribbon.

By providing a continuous ribbon of handle bags having the sizes of the plastics bags commonly known in the prior art, and by rolling-up said ribbon on a central core, it was found that the resulting roll was scarcely stable. At its lateral regions, the handle bag comprises four layers of material, while at its intermediate region it comprises only two layers. According to the known prior art, the typical width dimensions of a usual handle bag are as follows:

Width of each lateral region (4 layers): 60 mm;
Width of the intermediate region (2 layers): 170 mm.

By rolling up a ribbon of bags presenting the dimensions according to the prior art, the resulting roll appeared as having lateral thickenings at the folded regions and, in contrast, it had an intermediate region, wider than the double of the lateral regions, which created a wide recessed portion (cavity) between the lateral thickenings. The presence of this wide recessed portion and, first of all, the limited support of the lateral layers, caused prominent lateral layers to tend to collapse inwardly onto the intermediate layer, whereby both the rolling up and successive unrolling of the roll could not be effected with the desired uniformity to achieve a proper operation of the dispensing and opening apparatus for which the continuous ribbon of bags was intended.

The best manner to obviate the disadvantage of the structural instability of a roll would be the ideal condition wherein the inner sides 1-101 of the folds S1-S2 would contact each other at the centerline of the bag. However, the bottom of the bag would be formed completely by corresponding lower portions of the folds and would have a funnel configuration with a lowermost central spot of very low strength and, therefore, liable to be torn easily due to the weight of the articles packed in a so-shaped bag.

Figure 2:
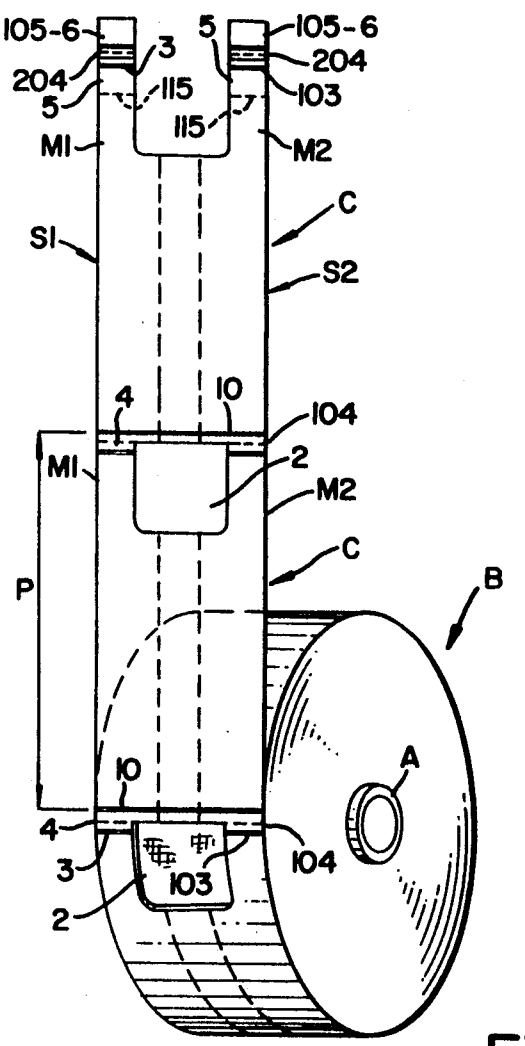
FIG. 2 is a perspective view of a roll made of a continuous ribbon of handle bags according to the invention.

According to the invention, it was found that it is possible to produce a bag having a bottom of good mechanical strength, by forming the folded portions with a total width up to the order of about 75% of the width of the flattened bag as from FIGS. 1 and 2. According to a preferred embodiment, the bag according to the invention has a width L (when flattened as in FIGS. 1 and 2) of 290 mm. The folds S1-S2 each have a width L1 of 110 mm, while an intermediate portion comprising two layers of superposed film between the inner sides 1-101 of the folds S1-S2 has a width L2 of 70 mm. This dimensioning of the bag ensures the required structural stability of the roll B formed by the continuous ribbon of pre-formed bags, enables the construction of bags having good capacity and good mechanical strength, while the width of the roll has been reduced to minimize the plan view dimensions of the parts designed to accommodate the roll, and to mount two rolls in proximity of each other for the purpose of feeding respective bag-dispensing and opening apparatuses arranged close to each other.

Figure 3:
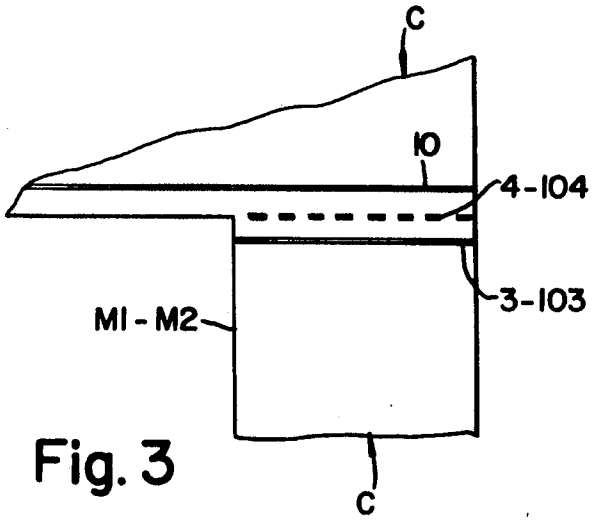
FIG. 3 is an enlarged plan view of one of the connection areas between two bags according to the invention.

In the manufacture and use of a continuous ribbon of pre-formed bags as described above, it has been found that the regions provided with weakening perforations or slits 4-104 (see also FIG. 3) must have such a tensile strength as to permit the roll to be properly unrolled and, at the same time, such as to permit a leading bag to be cyclically torn apart from the following ones. For this purpose, it has been found that the whole of weakening perforations or slits 4-104 should not comprise more than 50% of the material in the weakened tear off area connecting the handles (top) of a bag to the bottom of the successive bag. Preferably perforations or slits 4-104 comprise about 45 to 50% of the material connecting two successive bags.

Figure 4:
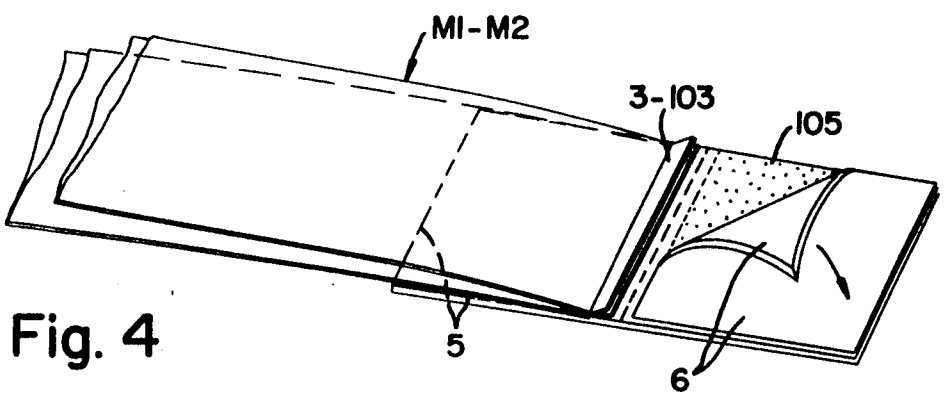
FIG. 4 is a perspective view of one of the adhesive bands provided at the ends of the continuous ribbon of pre-formed bags, for the purpose of ensuring a continuous supply of said bags to the dispensing and opening apparatus.

With reference to FIGS. 2 and 4, it will be noted that the handles of the leading bag of each roll have affixed thereto adhesive bands 115 which protrude from each handle with a protruding portion 105, also coated with adhesive and covered with a protective tab 6, for example of silicone-coated paper. The protruding portion 105 of the band is connected to a connecting portion 5 of the band 115 by means of a weakened area 204 similar to the weakened tear-off area 4-104 described above. When a roll of bags is about to be exhausted, the adhesive portions 105 of the leading bag of the new roll are deprived of the protective tab 6 and are caused to adhere to the rear end of the last bag of the exhausted roll, thus ensuring the required continuous feeding to the bag-dispensing and opening apparatus. The portion 105 remains secured to the last bag of the exhausted roll, while the portion 5 remains secured to the leading bag of the new roll when the bags are torn apart from each other along the perforation lines 204.

Figure 10:
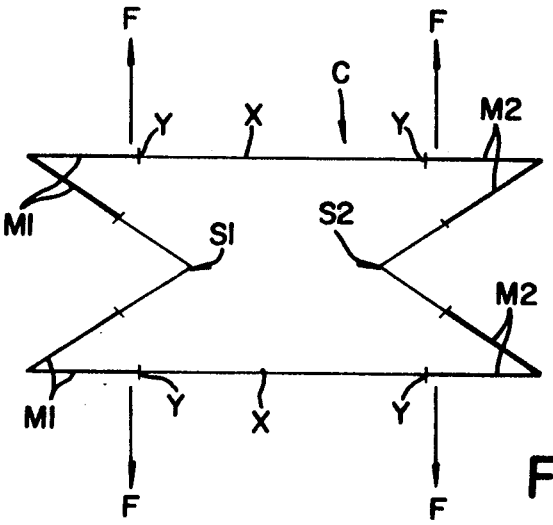
FIGS. 9, 10, 11 are cross sectional views of the bag on the line IX—IX of FIG. 1 and during successive steps of its opening operation.
Figure 11:
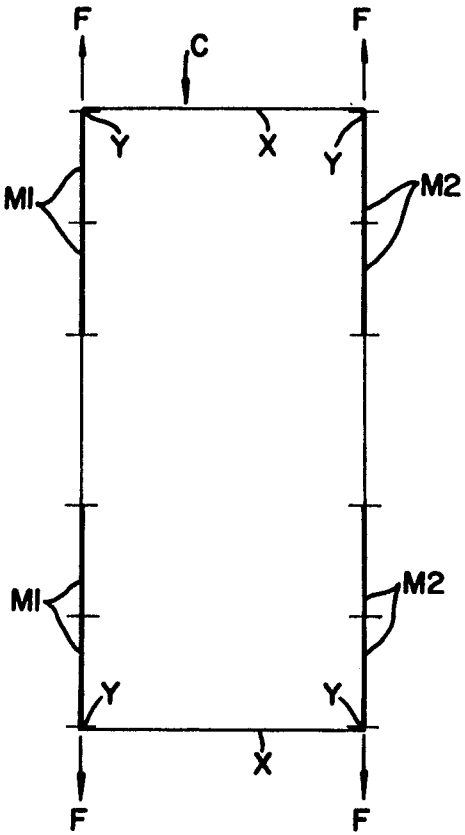
Figure 9A:
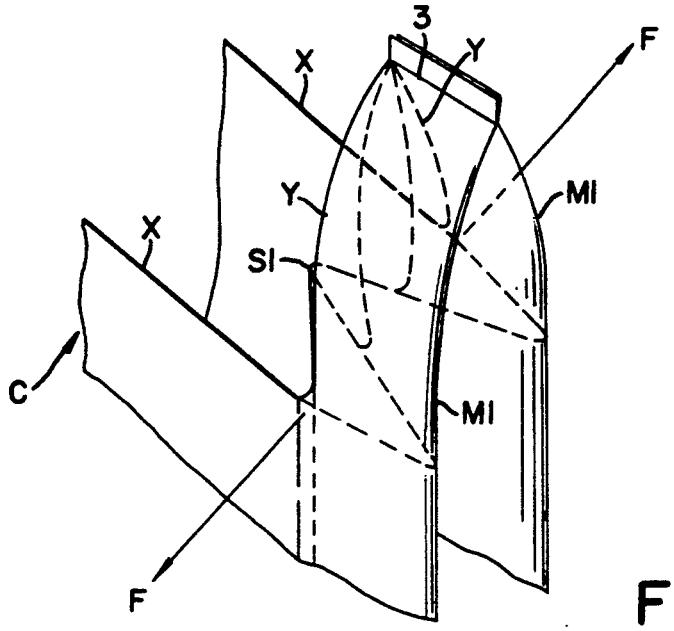
FIGS. 9*a*, 10*a* and 11*a* are perspective views, complete or partial, of the bag during the same steps of the opening operation of FIGS. 9, 10 and 11.
Figure 10A:
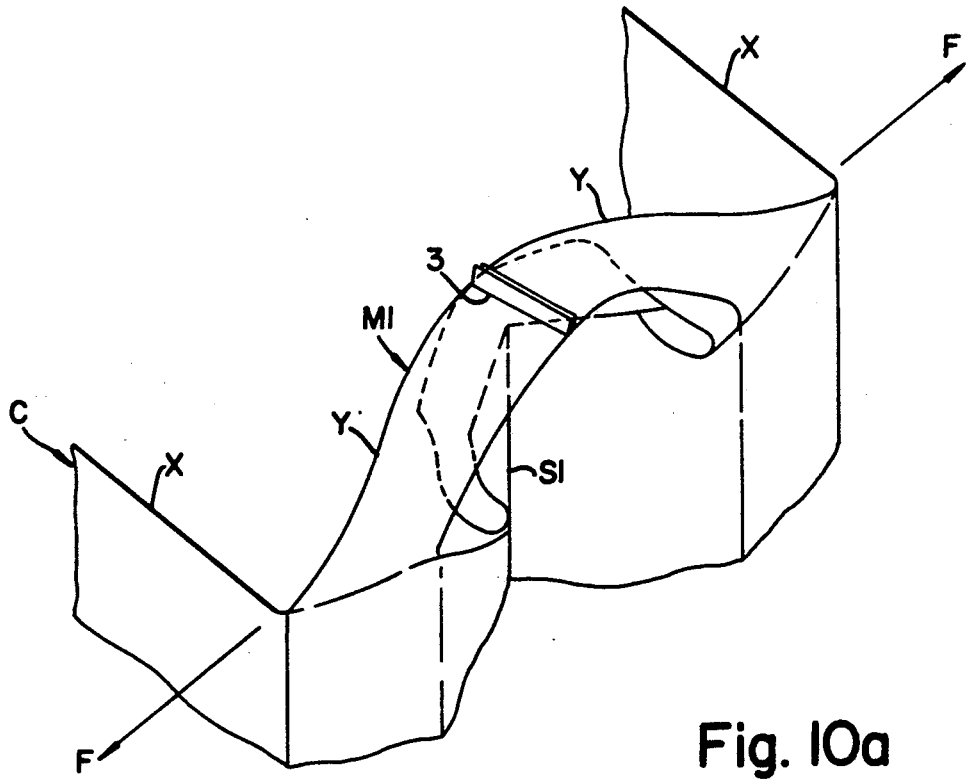
Figure 11A:
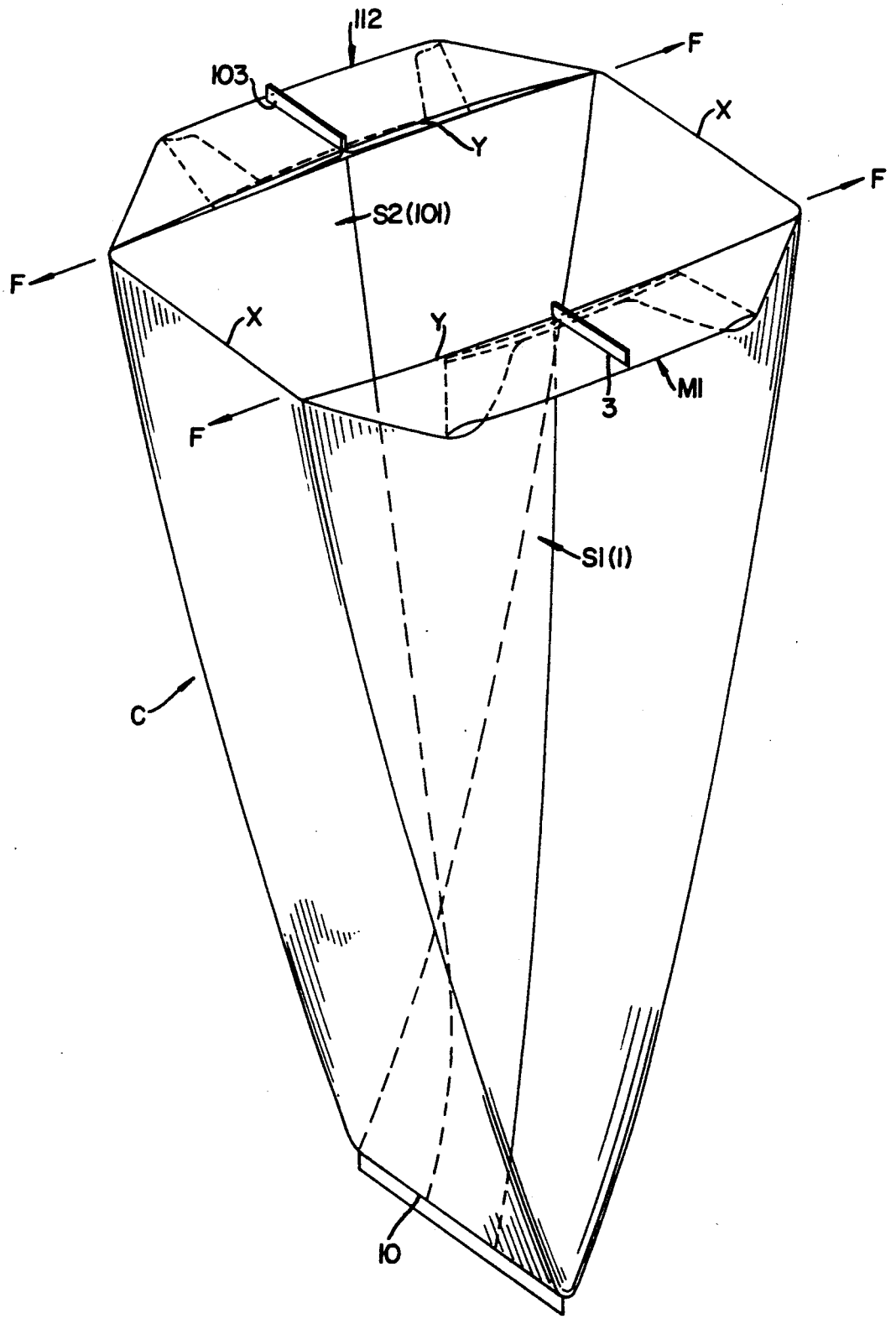

A further problem which has been solved by the invention is the appropriate opening of a bag by the dispensing and opening apparatus. To achieve this object, the handles have been dimensioned with the following ratio with respect to the bag as specified above. The handles M1-M2 have a width L3 of about 60–65 mm and height H of about 160 mm. With reference to FIGS. 9-10-11 and **9*a*-10*a*-11*a*, it will be noted that the bag is opened by parallelly spacing apart the portions X of the top mouth between the opposite handles M1-M2, as indicated by the arrows F. The distance between the portions X, along an inner side Y of the handles M1-M2 is the double of the height of the handles, i.e. $160\times2=320$ mm. The distance between the portions X, along the length of the mouth of the bag included between the ends of one handle (the two points where inner side Y joins the mouth), is equal to the sum of the width of the handle (60–65 mm), plus the width of two creases of a fold S1 or S2** ($110\times2=220$ mm) and plus a further width of the handle (60–65 mm), thus amounting to a total of:

$$(60\text{–}65)+220+(60\text{–}65)=\text{from 340 to 350 mm.}$$

It follows from the above that during the opening step of a bag, as illustrated in sequence of Figures referred to above, the inner side of the handles (320 mm) is tensioned in advance of the mouth portion of the bag, included between the ends of each handle (340 mm), whereby the handles tend to be maintained on the outer side of the mouth of the bag or anyway to arrange themselves always in a pre-established and not random position with respect to the mouth of the bag, as clearly shown in the sequence of FIGS. **9*a*-10*a*-11*a***. This condition facilitates the opening of the bag and may be summarized by the following proposition: "the height of the handles must be either equal to or slightly different from half the shortcut distance along the portion of the mouth of the bag included between the two points where inner sides Y of each handle" join the mouth of the bag.

In order to give to the roll B a better structural stability (see FIG. 6), the pre-formed bags instead of having the cutout openings 2 there may only be vertical opposite cuts 102-202. The vertical cuts 102-202 be cuts preferably terminating at their lower end with a small rounded portion 7 to avoid the formation of zones of limited strength where tearing of a filled bag could take place. In this case, the two weakened zones presenting the perforations 4-104 would be replaced by a single weakened zone 304 extending throughout the width of the bag, so that when the handle bag will be torn off along the single weakened zone 304, two flaps 8 are formed at the top thereof, which can serve to close the mouth of the filled bag.

Figure 8:
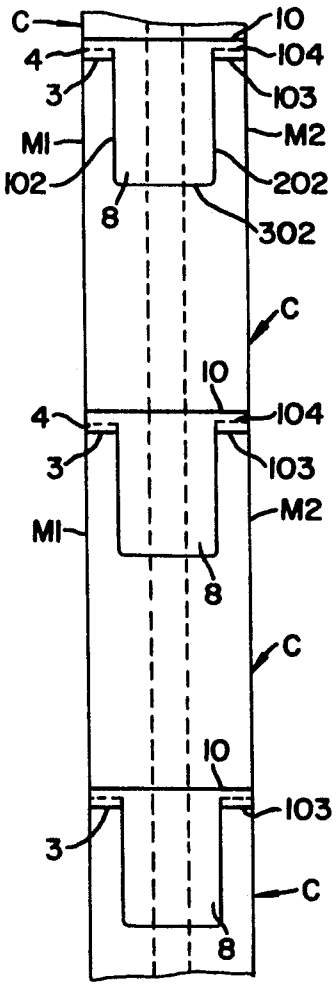
FIGS. 6, 7 and 8 are plan views of the ribbon of bags according to three modified embodiments.
Figure 7:
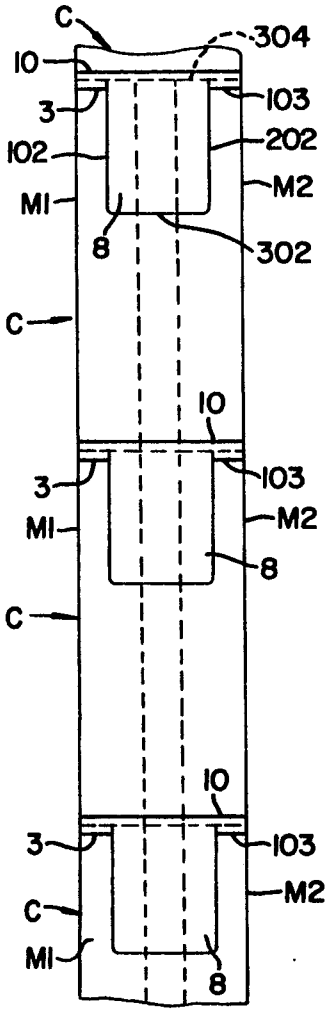
Figure 6:
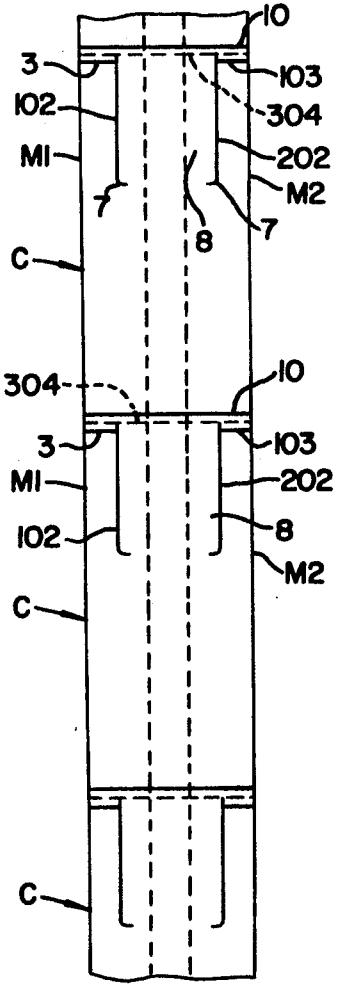

According to the modification of FIG. 7, intended to achieve the same advantage of the embodiment of FIG. 6, it may be contemplated to provide, in addition to the vertical cuts 102-202, a transverse cut 302 whereby, during the separation of a bag, the latter will have flaps 8 attached to its bottom, which flaps may be removed successively by a tear-off action along the perforation 304. The cuts 102-202-302 can be incomplete, so that said flaps remain connected to the continous ribbon of pre-formed bags only at easily tearable points, which is merely to prevent the flaps from being of hindrance during the unrolling and conveying of the ribbon of bags to the dispensing and opening apparatus. According to the further modification of FIG. 8, the line of perforations 304 can be replaced by the partial perforations 4-104 so that the flaps 8 will remain connected to the bottom of the bags, for example, to display an advertising message.

Figure 5:
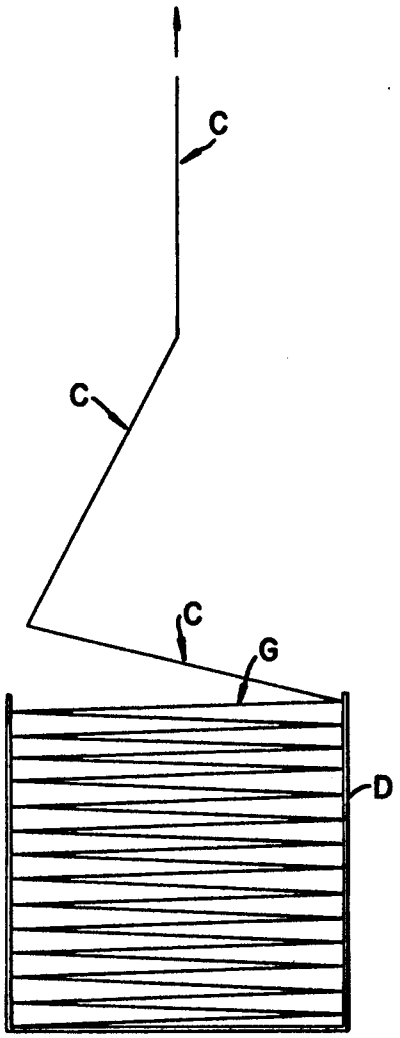
FIG. 5 shows diagrammatically a different type of package inside which the continuous ribbon of pre-formed bags can be gathered.

It is to be understood that the handle bag described above is intended to be protected even if the continuous ribbon comprising a plurality of bags is arranged, in the form of a "concertina" G with a zigzag configuration, inside a carton D, as shown in the modification of FIG. 5, in which each broken line C represents a handle bag.

We claim:

1. A plurality of connected handle bags, each said handle bag being made of plastic film and having a width when flattened, each said bag comprising an upper end defining a bag mouth;

a lower end defining a bag bottom;

two opposite vertical folded side portions each having four superposed layers of film and having a handle at said upper end of said bag, each said vertical side portion having a width not smaller than one third of said width of said bag when said bag is flattened; and an intermediate portion between said folded side portions, said intermediate portion comprising two layers of superposed film, each said bag being connected, in end-to-end relationship to other bags of said plurality of bags by weakened tear-off areas to form a continuous ribbon of bags, each said weakened tear-off area having a width and having weakening slits or perforations comprising no more than 50% of said width of said tear-off area.

2. A plurality of connected handle bags according to claim 1, wherein said bag has a width when flattened of 290 mm; each folded side portion has a width of 110 mm; and said intermediate portion has a width of 70 mm.

3. A plurality of connected handle bags according to claim 1, wherein said weakening slits or perforations comprise 45% to 50% of the width of each said weakened tear-off area.

4. A plurality of connected handle bags according to claim 1, further comprising a leading bag on said continuous ribbon of bags which includes respective adhesive bands extending from respective handles of said leading bag, each said adhesive band having a protruding portion which is protected by a removable tab and a connecting portion comprising an upper end of said respective handle, said protruding portion being secured to said connecting portion by a weakened area having perforations for tear-off separation of said protruding portion from said connecting portion to allow said adhesive bands of said leading bag to be connected to a trailing bag of an exhausted ribbon.

5. A plurality of connected handle bags, each said handle bag being made of plastic film and having a width when flattened, each said bag comprising an upper end defining a bag mouth;

a lower end defining a bag bottom;

two opposite vertical folded side portions each having four superposed layers of film and a handle at said upper end, each said vertical side portion having a width not smaller than one third of said width of said bag when said bag is flattened; and an intermediate portion between said folded side portions, said intermediate portion comprising two layers of superposed film, each said bag being connected in end-to-end relationship to other bags of said plurality of bags by mentioned tear-off areas to form a continuous ribbon of bags, each of said handles of each said bag having an inner side and each of said handles having a height which is substantially equal to half the distance along said bag mouth between two points where said inner side of said handle is connected to said mouth.

6. A plurality of connected handle bags according to claim 5, wherein each of said bags has a width of 290 mm and said handles have a height of 160 mm and a width of from 60 to 65 mm.

7. A plurality of connected handle bags according to claim 5, further comprising material included between said handles, said material including vertical cuts which define said inner sides of said handles.

8. A plurality of connected handle bags according to claim 7, wherein said vertical cuts include lower ends with rounded edges.

9. A bag according to claim 7, wherein said handles are defined by two pairs of said vertical cuts, two lower transverse cuts, each said transverse cut uniting one pair of said vertical cuts.

* * * * *